United States Patent [19]

Stelter et al.

[11] Patent Number: 4,951,024

[45] Date of Patent: Aug. 21, 1990

[54] HIGH EFFICIENCY SATURATING REACTOR FOR STARTING A THREE PHASE MOTOR

[75] Inventors: William F. Stelter, Libertyville; James S. Nasby, Skokie, both of Ill.

[73] Assignee: Master Control Systems, Inc., Lake Bluff, Ill.

[21] Appl. No.: 457,376

[22] Filed: Dec. 27, 1989

[51] Int. Cl.[5] ..... H01F 29/00; H01F 27/26

[52] U.S. Cl. ..... 336/5; 336/10; 336/210; 336/212

[58] Field of Search ..... 336/5, 10, 12, 92, 210, 336/212, 216, 217, 234

[56] References Cited

U.S. PATENT DOCUMENTS

| | | | |
|---|---|---|---|
| 1,386,828 | 8/1921 | Winston | 336/12 |
| 3,411,121 | 11/1968 | Twomey | 336/210 |
| 3,436,707 | 4/1969 | Derbyshire et al. | 336/210 X |
| 3,745,499 | 7/1973 | Smith | 336/212 X |
| 3,760,316 | 9/1973 | Czewski et al. | 336/210 |

*Primary Examiner*—Thomas J. Kozma

*Attorney, Agent, or Firm*—James M. Wetzel; Jon Carl Gealow

[57] ABSTRACT

A three phase saturating reactor is constructed of thin E and I shaped laminations that are interleaved to minimize the effects of air gaps. The laminations include apertures that are in alignment and four identical frame members are secured thereto by means of insulated bolts that pass through the apertures in the core and corresponding holes in the frame members. The taps of the electrical phase coils that encircle the legs of the core are of heavy conductors that are self-supporting. The saturating reactor design is such that the core is driven into saturation at a small percentage of the rated current of the reactor to rapidly develop a back EMF when in a motor starting circuit.

3 Claims, 2 Drawing Sheets

HIGH EFFICIENCY SATURATING REACTOR FOR STARTING A THREE PHASE MOTOR

BACKGROUND OF THE INVENTION AND PRIOR ART

This invention relates in general to motor starting devices and in particular to high efficiency saturating reactors for starting three phase motors. The problem of high in-rush starting currents for motors has been long recognized in the art. A number of techniques have been developed for reducing these high motor starting currents, which may be as much as six times the full load motor operating current. A common technique is to insert a magnetic reactor between the AC source and the motor during start up, with the reactor being switched out of the circuit when the motor has achieved a certain percentage of its rated speed. The reactor presents an impedance and thereby restricts the magnitude of current flow to the motor. The amount of the current restriction is related to the voltage drop across the reactor, which is referred to as the back EMF. A most important criterion in a motor starting system is the load imposed upon the power supply. Previously the most efficient starting systems, i.e. those having minimum power (KW) consumption, utilized primary autotransformers which produced relatively low power loss while developing a significant voltage drop for reducing the motor starting current. Primary reactors are less costly than autotransformers but are less efficient.

A large number of motor systems comprise engine driven generators (gen-sets) for supplying the power. For gen-sets, the electrical power efficiency of the motor starting method is of even greater importance since it directly affects the size of the gen-set required.

While greater efficiency and lower cost are always desirable in a starting system, the gen-set is not detrimentally impacted by the higher kilovolt ampere (KVA) or kilovolt amperereactive (KVAR) of motor starting reactors.

It is present practice to provide starting reactors that are specifically designed for a particular motor voltage and current rating. The result is that a supplier of motor starting reactors must stock a very large number of different sizes of reactors, which adds greatly to his costs and increases storage space requirements. Also, present day saturating reactors are inefficient and consume a significant amount of real power (watts) as compared with the desired apparent or reactive power. The back EMF of the reactor is a function of current and whether the current generates real power is immaterial in reducing the starting voltage. Ideally the saturating reactor will have a zero power factor and consume no real power. This would allow a smaller gen-set to be used in a given motor starting application.

All reactor designs utilize tapped electrical coils coupled to a magnetic core. A typical three phase motor starting reactor includes three separate coils, each wound about one leg of a core having three legs and two windows. Each coil has a number of individual taps to provide different impedance combinations for a variety of different starting characteristics.

One reason for the inefficiency of prior art motor starting saturating reactors is the presence of air gaps in the magnetic path in the core structure. The gaps are the result of the type of construction employed where the magnetic core is "pieced" together and welded.

Such construction also has a high degree of radiated magnetic flux and required special mounting precautions.

The reactor of the invention is more efficient than those of the prior art and is designed to be driven into deep saturation very rapidly. This provides a low power factor, i.e. minimum coil loss and overall power loss. The reactor of the invention also has a core constructed of conventional thin, insulated E and I shaped pieces of laminated magnetic material that are interleaved to minimize the effects of the small discontinuities between the legs of the abutting E and I pieces. This construction also minimizes radiated flux and permits stacking of units with minimum magnetic interaction between them. The coils are insulated for use with 600 volt motors and are of electrical grade copper in a close wound configuration to efficiently fill the window areas of the core. The conventional 80 percent tap on each coil is replaced with other taps which gives more flexibility in adapting the coils to multiple uses. The construction is such that reactor-to-reactor uniformity is maintained, which permits a supplier to stock a significantly smaller number of reactors. Such uniform reactors may be readily combined (in series and in parallel) to provide a wide range of different motor starting characteristics. Another advantage of the inventive design is achieved by securing the core structure and identical frame members with insulated bolts for minimizing core loss and providing flexibility and ease in installation. With the inventive designs, the number of reactors required by the assignee of the present invention, was reduced from 69 to 6. These 6 basic reactor sizes serve a gamut of 3 phase motors ranging from 13 Hp (20 KVa) through 400 Hp (574 KVa).

OBJECTS OF THE INVENTION

A principal object of the invention is to provide an improved 3 phase motor starting saturating reactor.

Another object of the invention is to provide a three phase motor starting saturating reactor of more efficient design.

BRIEF DESCRIPTION OF THE DRAWINGS

These and other objects and advantages of the invention will be apparent upon reading the following description in conjunction with the drawings, in which.

DESCRIPTION OF THE PREFERRED EMBODIMENT

Figure 1:
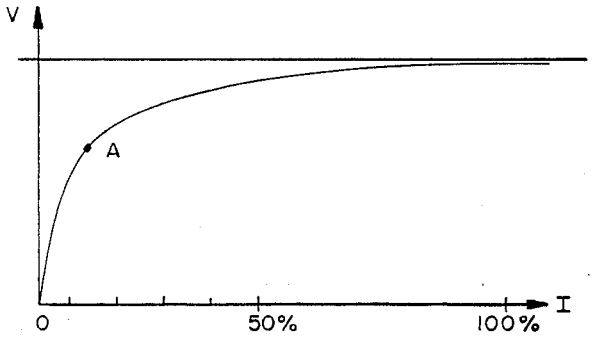
FIG.1 ( PRIOR ART )
FIG. 1 the voltage-current characteristic of a typical motor starting saturating reactor of the prior art.
Figure 2:
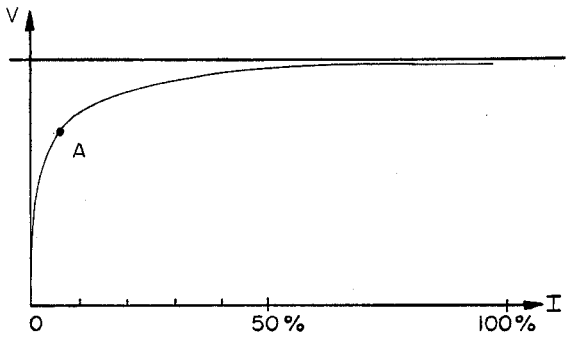
FIG. 2 is a corresponding voltage-current characteristic of a corresponding motor starting saturating reactor constructed in accordance with the invention.

The prior art curve of FIG. 1 illustrates the voltage-current characteristic of a typical motor starting reactor. A denotes the point where approximately one-half of the operating voltage (back EMF) is reached. It will be seen by comparing the prior art reactor of FIG. 1 with the reactor constructed in accordance with the invention in FIG. 2, that point A is reached at about 5% of the operating current for the prior art device and at about 1% of the operating current for the inventive device. This is a critical feature of the inventive design, enabling deep saturation of the reactor to be achieved very quickly, and accounts for its high efficiency and low power factor, which translates into low power loss.

The construction of the magnetic core, with E and I shaped interleaved laminations to minimize air gap effects, the bolting of the core laminations (and the identical frame members) to further minimize air gap effects, as well as the arrangement of the coils to fully utilize the window space in the core, permits the units to be replicated with a high degree of uniformity. Consequently, the units may be arranged to operate in combination with each other and thereby provide for handling the voltage and current requirements of a greater number of motor sizes.

Figure 3:
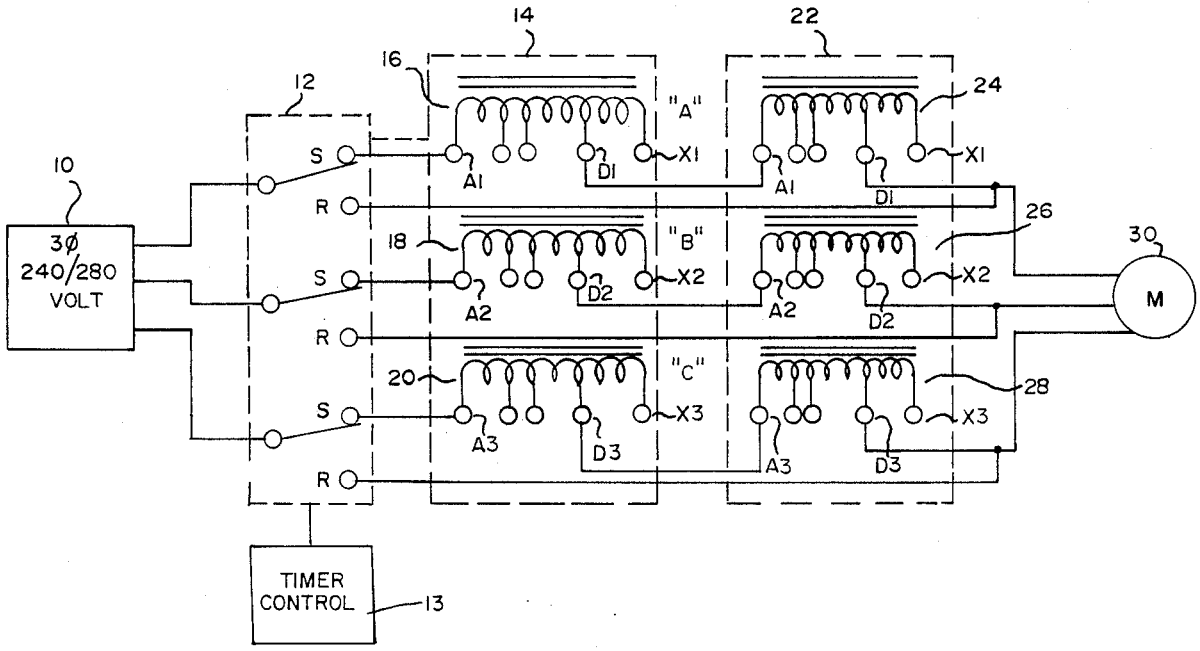
FIG. 3 is a schematic diagram of a series arrangement of reactors constructed in accordance with the invention.

The use of a pair of three phase reactors in series for starting a motor from a higher voltage source is illustrated in FIG. 3. A three phase voltage source 10 is connected through a three phase switching arrangement 12 to a first three phase motor starting reactor 14 through respective switch contacts "S". The switch contacts "R" serve to connect the source directly to a three phase motor 30. Reactor 14 is connected in series with a second three phase motor starting reactor 22, which is also connected to three phase motor 30. A timer control 13 is coupled to switch 12 and operates its S and R contacts to such that the switch blades close a circuit via the S contacts between source and the reactors for a predetermined time period for starting, and then close a circuit between the source and motor via the R contacts. (S contacts may be left closed or opened). In practice the acceleration time, i.e. the time that the S contacts are closed, is from 1 to 10 seconds depending upon the size of the motor. During this period the motor is supplied with reduced voltage because of the reactor (or reactors) and the KW, KVA and KVAR are all reduced. After the time out period of timer control 13, the motor is directly connected to the source via the R contacts, which effectively removes the reactors from the circuit if the S contacts are permitted to remain closed in the particular design.

Reactor 14 includes three electrical windings or phase coils 16, 18 and 20, each having five taps A1, B1, C1, D1, X1—A1, B2, C2, D2, X2—and A3, B3, C3, D3, X3. The windings 16, 18 and 20 correspond to the three electrical phases A, B and C of the three phase AC input line voltage. Similarly, reactor 22 has three electrical windings 24, 26 and 28 with similarly designated taps.

Figure 6:
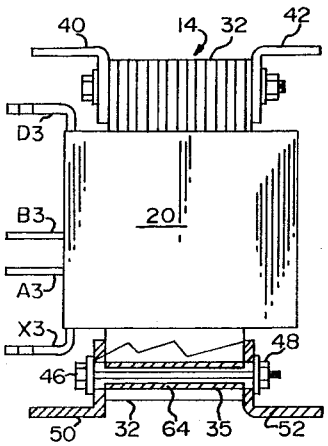
FIG. 6 is a right side view of the reactor of FIG. 5.
Figure 4:
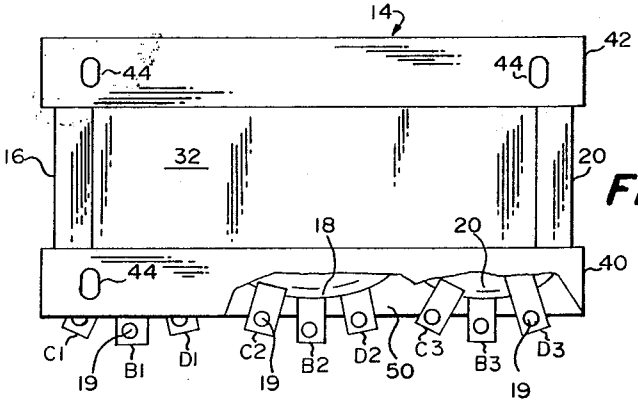
FIG. 4 is a top view of a three phase reactor of the invention.
Figure 5:
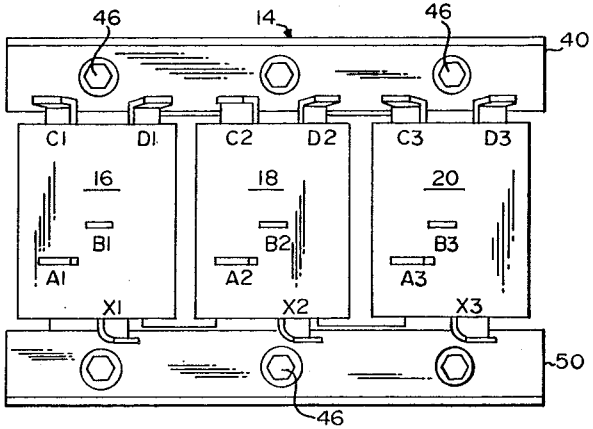
FIG. 5 is a front view of the reactor of FIG. 4.

In FIGS. 4, 5 and 6, the three phase reactor 14 of the invention is illustrated. A magnetic core 32 of a conventional two window, three leg construction consists of a plurality of thin insulated laminations of magnetically permeable material. The laminations are of standard E and I shape and design with each of the leg widths being equal and are interleaved to stagger the junctions between the legs of the E pieces and the I pieces. This is a common core arrangement for transformers but represents a departure from the prior art construction of motor starting reactor design where the core comprises a plurality of welded together rectangular stacks of laminations.

Figure 7:
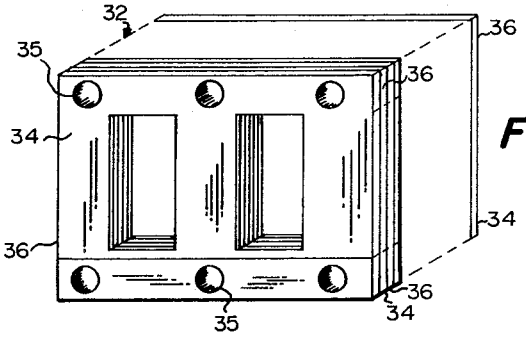
FIG. 7 is a perspective view of a magnetic core showing the interleaved E and I construction used in the reactor of the invention.

As best shown in FIG. 7, the magnetic core 32 includes a plurality of apertures 35 that are used to support identical frame members 40, 42, 50, 52 as well as to compress the laminations together and to maintain core integrity. The various taps, for example A1, B1, C1, D1 and X1 of coil 16, are constructed of relatively heavy gauge metal conductor and are self-supporting. Each includes an aperture 19 by which electrical connections may be made without the need for additional supporting structures. Each frame member includes a pair of oval shaped mounting holes 44 (one at each end) for enabling the reactor structure to be conveniently positioned and secured. It should be apparent that the identical frame members facilitate the stacking of the reactors and, in general, makes the design layout easier. Apertures 35 have larger diameters than the shanks of the bolts 46 which, in conjunction with nuts 48, are used to secure the frame members and the laminations of magnetic core 32 together. Insulating cylindrical sleeves 64 (see FIG. 6) fit in the apertures 35 and permit the shanks of the bolts 46 to pass therethrough to enable bolts 46 to secure the frame members and the magnetic core 32 without making metallic contact which would otherwise electrically (and magnetically) bridge the core laminations, causing circulating heating currents and increasing power (KW) consumption.

The thickness, size and number of the E and I laminations, as well as the wire size and number of turns and window sizes are selected to provide required voltages at the taps over the wide range of currents with minimum power loss (both copper loss and core loss), and to enable the core to be quickly driven into saturation.

What is claimed is:

1. A three phase motor starting saturating reactor comprising:

a magnetic core including a plurality of thin E and I shaped laminations alternately stacked to minimize air gaps and defining three legs and two windows;

four identical frame members, two each being positioned on each side of said core;

a plurality of mounting apertures formed in said core;

a corresponding plurality of insulated bolts extending through respective ones of said apertures for securing said frame members and said core together; and three individual multi-tapped electrical phase coils coupled to the legs of said core and substantially fully occupying said windows, said core being designed to be driven into saturation at about 5% of its rated current.

2. The reactor of claim 1 wherein each of said multi-tapped coils has a plurality of taps comprising conductive elements that are substantially self-supporting.

3. A closed magnetic core comprising:

a plurality of thin interleaved E and I shaped laminations formed of magnetic material and establishing a magnetic path comprising three legs forming two windows;

a plurality of aligned apertures symmetrically positioned in said laminations;

four identical frame members, each including a number of holes corresponding in number to one-half of said apertures and being in alignment therewith;

an insulated sleeve in each said aperture;

a bolt in each insulated sleeve for securing said frame members to said laminations via said apertures and said holes with a minimum number of air gaps;

three identical tapped coils, respectively positioned about said three legs; and said core saturating at a small percentage of its rated current to rapidly develop an operating back EMF in a motor starting circuit.

* * * * *

UNITED STATES PATENT AND TRADEMARK OFFICE

CERTIFICATE OF CORRECTION

PATENT NO. : 4,951,024

DATED : August 21, 1990

INVENTOR(S) : William F. Stelter and James S. Nasby

It is certified that error appears in the above-identified patent and that said Letters Patent is hereby corrected as shown below:

Column 4, claim 1, line 46, cancel the numeral "5" and substitute the numeral -1-

Column 4, claim 1, line 47, cancel "its rated" and substitute -the operating-

Column 4, claim 1, line 47, after "current" and before the period, insert -of the three phase motor

Signed and Sealed this

Twenty-fourth Day of December, 1991

*Attest:*

HARRY F. MANBECK, JR.

*Attesting Officer*

*Commissioner of Patents and Trademarks*